US008731429B2

(12) United States Patent
Asami

(10) Patent No.: US 8,731,429 B2
(45) Date of Patent: May 20, 2014

(54) IMAGE FORMING APPARATUS

(75) Inventor: Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 13/309,404

(22) Filed: Dec. 1, 2011

(65) Prior Publication Data

US 2012/0148290 A1 Jun. 14, 2012

(30) Foreign Application Priority Data

Dec. 8, 2010 (JP) ..... 2010-273895

(51) Int. Cl.
*G03G 21/20* (2006.01)
*G03G 15/20* (2006.01)

(52) U.S. Cl.
CPC ..... *G03G 21/20* (2013.01); *G03G 21/206* (2013.01); *G03G 15/2017* (2013.01); *G03G 15/205* (2013.01); *G03G 15/2078* (2013.01)
USPC ..... 399/92; 399/94; 399/329

(58) Field of Classification Search
CPC G03G 15/205; G03G 15/2078; G03G 21/206
USPC ..... 399/92, 94, 329
See application file for complete search history.

(56) References Cited

U.S. PATENT DOCUMENTS

| | | | | |
|---|---|---|---|---|
| 5,479,243 | A * | 12/1995 | Kurokawa et al. | 399/159 |
| 2006/0254292 | A1* | 11/2006 | Allen et al. | 62/179 |
| 2007/0059012 | A1* | 3/2007 | Tomine et al. | 399/69 |

FOREIGN PATENT DOCUMENTS

| | | | | |
|---|---|---|---|---|
| JP | 60010280 | A * | 1/1985 | G03G 15/20 |
| JP | 4-051179 | A | 2/1992 | |
| JP | 6-019346 | A | 1/1994 | |
| JP | 2006-119430 | A | 5/2006 | |
| JP | 2006-293134 | A | 10/2006 | |
| JP | 2007-079033 | A | 3/2007 | |
| JP | 2007-079040 | A | 3/2007 | |
| JP | 2007-187816 | A | 7/2007 | |
| JP | 2007-322470 | A | 12/2007 | |
| JP | 2008-032903 | A | 2/2008 | |
| JP | 2008-032904 | A | 2/2008 | |
| JP | 2008-040235 | A | 2/2008 | |
| JP | 2008-052031 | A | 3/2008 | |
| JP | 2008-058378 | A | 3/2008 | |
| JP | 2009-109722 | A | 5/2009 | |
| JP | 2009-288275 | A | 12/2009 | |
| JP | 2009-300856 | A | 12/2009 | |
| JP | 2010-266705 | A | 11/2010 | |
| JP | 2011-150317 | A | 8/2011 | |

* cited by examiner

*Primary Examiner* — Benjamin Schmitt

(74) *Attorney, Agent, or Firm* — Canon U.S.A., Inc., IP Division

(57) ABSTRACT

The present invention prevents condensation on a pressure roller and excessive temperature rise of a non-paper-passage portion of a fixing unit by switching a blower unit that cools the fixing unit between a blowing mode in which the blower unit sends air to the non-paper-passage portion and an exhausting mode in which a fan of the blower unit is rotated reversely and the air in the fixing unit is exhausted out of the apparatus.

14 Claims, 14 Drawing Sheets

IMAGE FORMING APPARATUS

BACKGROUND OF THE INVENTION

1. Field of the Invention

The present invention relates to an electrophotographic or electrostatic image forming apparatus such as a copying machine or a printer.

2. Description of the Related Art

An image forming apparatus that forms a toner image on a recording material has a fixing unit for heat-fixing the toner image to the recording material. In the case where a toner image formed on a narrow recording material is fixed by the fixing unit, non-paper-passage regions through which the recording material does not pass overheat, and so various countermeasures to this phenomenon have been proposed. As one of them, Japanese Patent Laid-Open No. 2008-52031 discloses blowing on the non-paper-passage regions of the fixing unit and thereby cooling the non-paper-passage regions. In a low heat capacity fixing unit such as a fixing unit of film heating type including an endless belt (fixing film), the heater does not generate heat during standby while waiting for a print signal. Even if the heater generates heat, the fixing unit is warmed to a very low temperature. Even in such a standby state, the fixing unit can be brought to a fixable state in a short time after the reception of a print signal. On the other hand, because the fixing unit is not warmed during standby, the pressure roller is likely to cool. For this reason, in the case where a recording material containing a large amount of moisture undergoes a fixing process with the temperature of the pressure roller low as in the early stage of printing (for example, the first sheet of continuous printing), the moisture contained in the recording material evaporates at once in the fixing nip portion and is likely to condense on the surface of the pressure roller. This condensation reduces the friction coefficient of the pressure roller and may cause a phenomenon in which the recording material slips and is not conveyed. This slip of the recording material will be referred to as condensation slip. In a fixing device of film heating type, a fixing film is driven by the rotation of a pressure roller, and a recording material is conveyed only by the driving force of the pressure roller. For this reason, if condensation occurs on the pressure roller, the conveying force decreases rapidly and the above-described slip phenomenon is likely to occur.

In order to solve this problem, it is possible to use fans for preventing excessive temperature rise of the non-paper-passage portions, to diffuse water vapor generated around the fixing unit with air taken in by the blower fans from the outside of the image forming apparatus, and to prevent condensation on the pressure roller. However, if air from the blower fans is sent to the fixing unit with the temperature of the pressure roller low, the temperature of members such as the pressure roller and the fixing film decreases, the fixing property of the toner image decreases, and an image defect may be caused.

SUMMARY OF THE INVENTION

The present invention provides an image forming apparatus that can prevent condensation slip in the early stage of printing using a blower fan for cooling a non-paper-passage region.

In an aspect of the present invention, an image forming apparatus includes a fixing unit that fixes an unfixed image to a recording material while nipping and conveying the recording material bearing the unfixed image, and a blower unit that sends air to a non-paper-passage portion of the fixing unit and cools the non-paper-passage portion, wherein the blower unit can be switched between a blowing mode in which the blower unit sends air to the non-paper-passage portion and an exhausting mode in which a fan of the blower unit is rotated reversely and the air in the fixing unit is exhausted out of the apparatus.

In another aspect of the present invention, an image forming apparatus includes a fixing unit that fixes an unfixed image to a recording material while nipping and conveying the recording material bearing the unfixed image, a blower unit that sends air to the fixing unit, and an exhausting unit that exhausts the air in the fixing unit out of the apparatus.

Further features of the present invention will become apparent from the following description of exemplary embodiments with reference to the attached drawings.

DESCRIPTION OF THE EMBODIMENTS

First Embodiment

Figure 1:
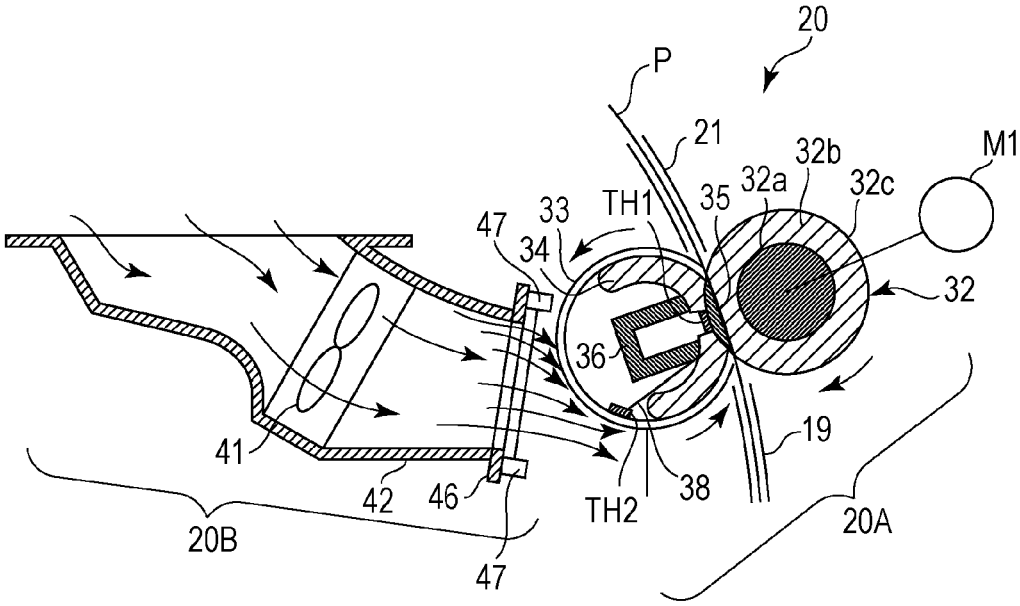
FIG. 1 is a sectional view of a fixing unit and a blower unit mounted in an image forming apparatus.
Figure 2:
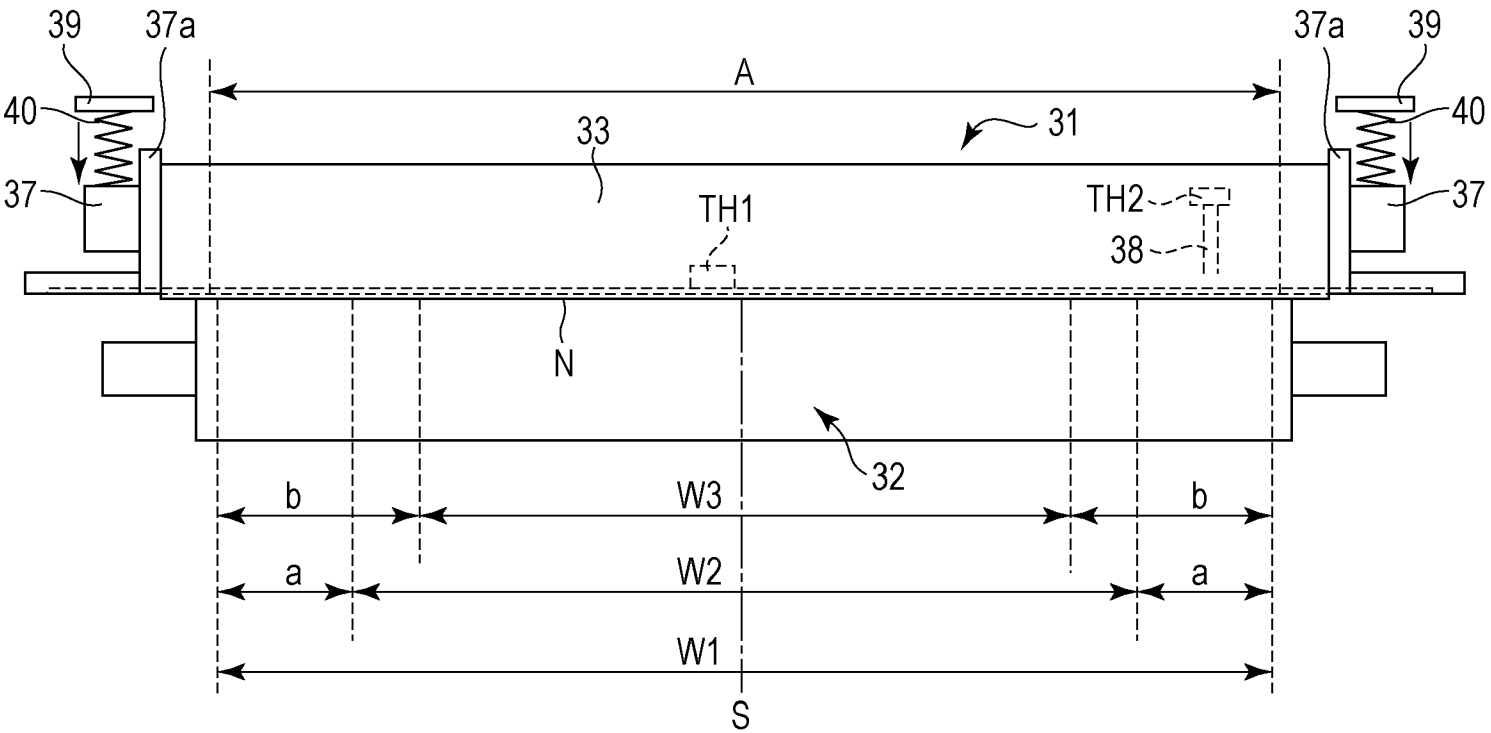
FIG. 2 is a front view of the fixing unit.
Figure 3:
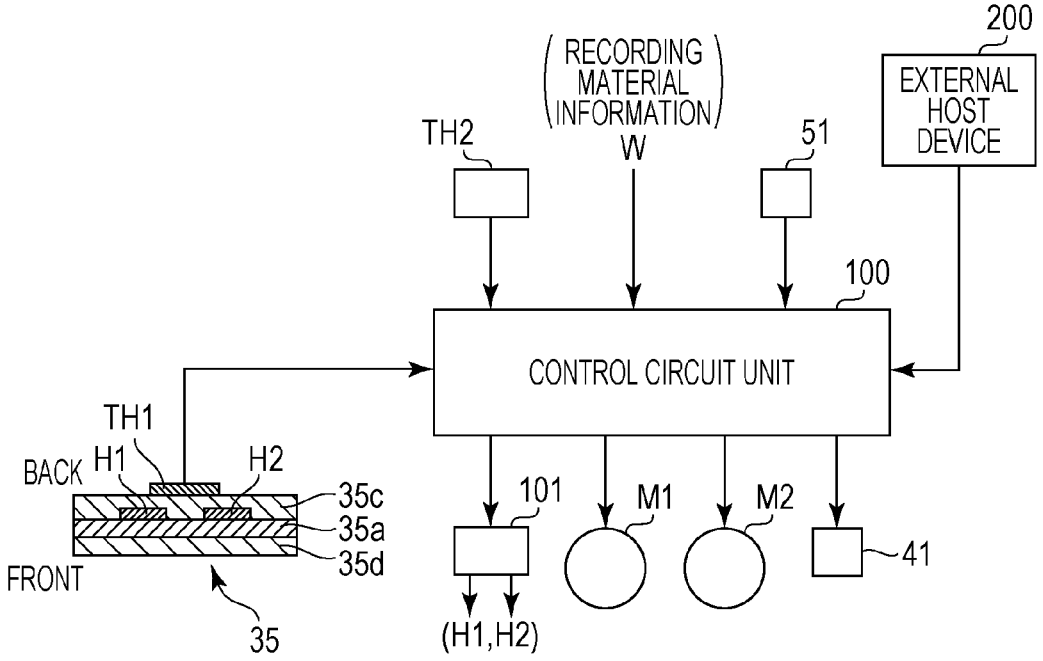
FIG. 3 shows a sectional view of a heater and a block diagram of a control system.

FIG. 1 is a sectional view of a fixing device (fixing unit) 20A and a blower unit 20B. FIG. 2 is a front view of the fixing device. FIG. 3 shows a sectional view of a heater and a block diagram of a control system. The fixing device and the blower unit are mounted in an image forming apparatus (not shown) such as an electrophotographic printer. The structure of the image forming apparatus other than the fixing device (fixing unit) 20A and the blower unit 20B is well known, and so the description thereof will be omitted.

First, the outline of the fixing unit 20A will be described. The fixing unit 20A is a fixing device of film heating type and pressure roller drive type (tensionless type). Reference numeral 31 denotes a film unit, and reference numeral 32 denotes a pressure roller. The two are pressed against each other, thereby forming a fixing nip portion. In the film unit 31, reference numeral 33 denotes a fixing film (an endless belt). Reference numeral 34 denotes a film guide member, and reference numeral 35 denotes a ceramic heater (hereinafter simply referred to as heater). The heater 35 is fitted in and fixed to a groove provided in the outer surface of the guide member 34 along the longitudinal direction. Reference numeral 36 denotes a rigid pressure stay made of metal, which is disposed inside the guide member 34. Reference numeral 37 denotes end holders attached to arm portions at both left and right ends of the stay 36, and reference numeral 37*a* denotes flange portions integral with the end holders 37. The pressure roller 32 is an elastic roller including a metal core 32*a*, an elastic layer 32*b* of silicone rubber or the like provided around the metal core 32*a*, and a fluororesin layer 32*c* of PTFE, PFA, FEP, or the like provided around the elastic layer 32*b*. Both ends of the metal core 32*a* of the pressure roller 32 are rotatably supported between left and right plates of the fixing device chassis (not shown) by bearing members. The film unit 31 is disposed parallel to the pressure roller 32 with the heater 35 facing the pressure roller 32. Pressure springs 40 are provided between the left end holder 37 and a left fixed spring-receiving member 39 and between the right end holder 37 and a right fixed spring-receiving member 39. The pressure springs 40 urge the stay 36, the guide member 34, and the heater 35 toward the pressure roller 32. As described above, the fixing unit 20A has an endless belt 33, a heater 35 in contact with the inner surface of the endless belt 33, and a pressure roller 32 that forms a fixing nip portion together with the heater with the endless belt 33 therebetween. While nipping and conveying a recording material bearing an unfixed image, the fixing nip portion heat-fixes the image to the recording material.

FIG. 3 shows a sectional view of the heater 35 and a control system diagram. The heater 35 has a heater substrate 35*a* made of ceramics, and resistance heating elements H1 and H2 formed on the heater substrate 35*a* along the longitudinal direction of the substrate. On the heating elements H1 and H2, a protective layer 35*c* of glass, fluororesin, or the like is provided. On a part in contact with the fixing film 33, a sliding layer 35*d* is provided.

When electric current is applied between both ends in the longitudinal direction of the heating elements H1 and H2 of the heater 35, the heating elements H1 and H2 generate heat, and the temperature of the heater 35 rises rapidly throughout an effective heat generating region width A (see FIG. 2) in the longitudinal direction of the heater. The heater temperature is detected by a first temperature sensor TH1, such as a thermistor, disposed in contact with the outer surface of the protective layer 35*c*. The output (the signal value for the temperature) therefrom is input through an A/D converter into a control circuit unit 100. On the basis of the input detected temperature information, the control circuit unit 100 controls the supply of electric power from a power source (power supply unit, heater drive circuit unit) 101 to the heating elements H1 and H2 independently on an element-by-element basis such that the heater temperature is maintained at a predetermined temperature (fixing temperature).

The pressure roller 32 is rotationally driven by a motor (drive unit) M1 in the clockwise direction in FIG. 1. Due to the frictional force in the fixing nip portion between the pressure roller 32 and the outer surface of the film 33 caused by the rotational driving of the pressure roller 32, a rotative force acts on the film 33. Due to this, the film 33 rotates, with its inner surface sliding on the heater 35 in the fixing nip portion, around the guide member 34 in the counterclockwise direction in FIG. 1 (pressure roller drive system). The film 33 rotates at a circumferential velocity substantially corresponding to the rotation circumferential velocity of the pressure roller 32. When the rotating film 33 moves to the left or right along the longitudinal direction of the guide member 34, the left or right flange portion 37*a* serves to receive the belt end and to restrict the movement.

On the basis of a print start signal based on image information input from an external host device 200, the rotation of the pressure roller 32 is started, and the heating up of the heater 35 is started. In a state where the rotation circumferential velocity of the film 33 has become constant and the temperature of the heater 35 has reached a predetermined temperature, a recording material P bearing a toner image t is introduced into the fixing nip portion with the toner image bearing surface facing the film 33. The recording material P is in close contact with the heater 35 with the film 33 therebetween in the fixing nip portion and passes through the fixing nip portion together with the film 33. In the process of passing, heat is applied to the recording material P by the film 33 heated by the heater 35, and the toner image t is heat-fixed to the surface of the recording material P. After passing through the fixing nip portion, the recording material P is separated from the surface of the film 33 and is conveyed for ejection.

In this example, the conveyance of the recording material P is performed by a middle reference conveyance method in which the middle in the width direction of a recording material is the conveyance reference. That is to say, in the case of any width recording material that can be used in the apparatus, the middle in the width direction of the recording material passes through the middle in the longitudinal direction of the film 33. S is a recording material middle passage reference line (imaginary line). W1 is the paper passage width of the widest recording material that can be passed through the apparatus (maximum paper passage width). In this example, this maximum paper passage width W1 is the width of A3 size, 297 mm (A3 longitudinal feed). The effective heat generating region width A in the longitudinal direction of the heater is slightly larger than this maximum paper passage width W1. W3 is the paper passage width of the narrowest recording material that can be passed through the apparatus (minimum paper passage width). In this example, this minimum paper passage width W3 is the width of A4 size, 210 mm (A4 longitudinal feed). W2 is the paper passage width of a recording material having a width between the maximum paper passage width and the minimum paper passage width. In this example, the paper passage width W2 is the width of B4 size, 257 mm (B4 longitudinal feed). Hereinafter, a recording material having a width corresponding to the maximum paper passage width W1 will be referred to as maximum size recording material, and a recording material narrower than this maximum size recording material will be referred to as small size recording material. In FIG. 2, a is the difference width portion ((W1−W2)/2) between the maximum paper passage width W1 and the paper passage width W2, and b is the difference width portion ((W1−W3)/2) between the maximum paper passage width W1 and the minimum paper passage width W3. That is to say, a and b are non-paper-passage portions formed when a B4 or A4R recording material, which is a small size recording material, are passed. Because the conveyance of recording materials is performed by the middle reference method in this example, the non-paper-passage portions a are formed on the left and right of the paper passage width W2, and the non-paper-passage portions b are formed on the left and right of the minimum paper passage width W3. The width of the non-paper-passage portions differs depending on the width of the small size recording material used. The first temperature sensor TH1 is disposed so as to detect the heater temperature (paper passage portion temperature) of the region corresponding to the minimum paper passage width W3. A second temperature sensor TH2 is, for example, a thermistor and detects the temperature of the inner surface of the film in the non-paper-passage portions. The output (the signal value for the temperature) therefrom is input through an A/D converter into the control circuit unit 100. In this example, the temperature sensor TH2 is disposed so as to elastically contact the inner surface of a part of the film corresponding to the non-paper-passage portion a. Specifically, the temperature sensor TH2 is disposed at the free end of a leaf-spring-like elastic supporting member 38 the base of which is fixed to the guide member 34. The temperature sensor TH2 elastically contacts the inner surface of the film 33 due to the elasticity of the elastic supporting member 38 and detects the temperature of the part of the film corresponding to the non-paper-passage portion a. The first temperature sensor TH1 may be disposed so as to elastically contact the inner surface of a part of the film corresponding to the minimum paper passage width W3. The second temperature sensor TH2 may be disposed so as to detect the heater temperature corresponding to the non-paper-passage portions a.

Figure 4A:
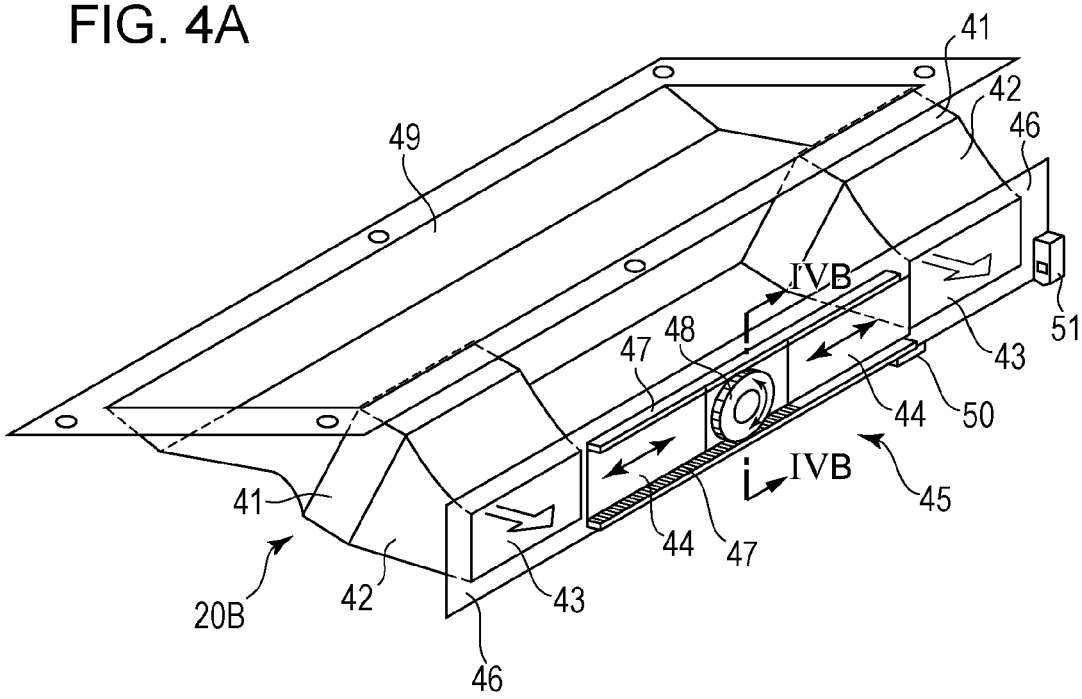
FIG. 4A is a perspective view of the blower unit.
Figure 4B:
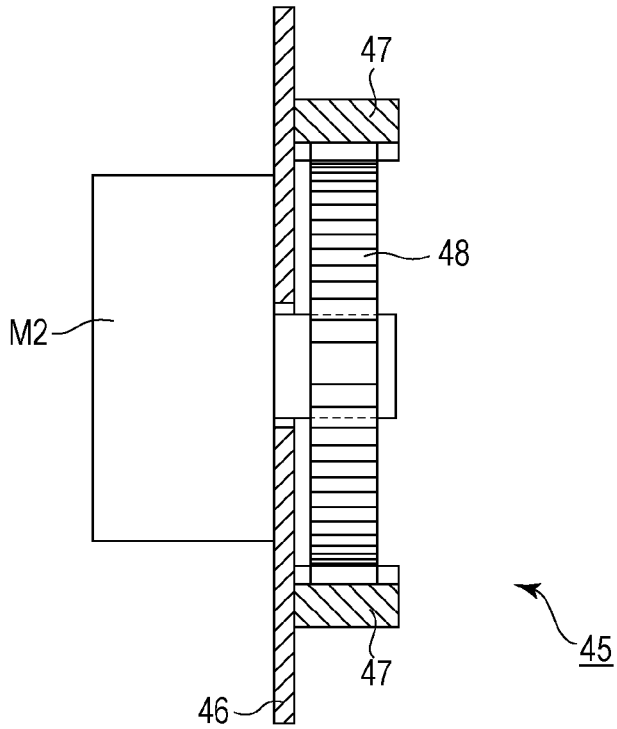
FIG. 4B is an enlarged view of a shutter drive unit.

The blower unit 20B can be set to a blowing mode in which the blower unit 20B sends air to the fixing unit, and an exhausting mode in which the blower unit 20B exhausts air near the fixing unit out of the fixing unit (out of the image forming apparatus). FIG. 4A is a perspective view of this blowing and exhausting mechanism unit (blower unit) 20B, and FIG. 4B is an enlarged view of a drive unit. FIG. 4B is a sectional view taken along line IVB-IVB of FIG. 4A. The blowing and exhausting mechanism unit 20B has fans 41. The blowing and exhausting mechanism unit 20B has ducts 42 that conduct air blown and exhausted by the fans 41, and openings 43 disposed in parts of the ducts 42 facing the fixing unit 20A. The blowing and exhausting mechanism unit 20B has shutters 44 that open and close the openings 43 and can change the width of the openings to a width suitable to the width of the recording material to be passed, and a shutter drive device (opening width adjusting unit) 45 that drives the shutters. The fans 41, the ducts 42, the openings 43, and the shutters 44 are disposed left-right symmetrically in the longitudinal direction of the fixing film 33. Centrifugal fans such as sirocco fans can be used as the fans 41. The left and right shutters 44 are supported slidably in the left-right direction along the plate surface of a supporting plate 46 in which the openings 43 are formed and that extends in the left-right direction. The left and right shutters 44 are connected by racks 47 and a pinion gear 48. The pinion gear 48 is rotationally driven in a forward or reverse direction by a motor (pulse motor) M2. Due to this, the left and right shutters 44 open and close the corresponding openings 43 in an interlocked manner and in a left-right symmetrical relationship. By the above-described supporting plate 46, racks 47, pinion gear 48, and motor M2, a shutter drive device 45 is formed. The left and right openings 43 each extend from a position slightly closer to the middle than the non-paper-passage portion b formed when the narrowest recording material is passed, to the end of the maximum paper passage width W1. The left and right shutters 44 move outward from the middle in the longitudinal direction of the supporting plate 46, thereby closing the openings 43 by a predetermined amount. The blowing and exhausting mechanism unit of this example prevents the temperature rise of the non-paper-passage portions of the fixing film by blowing directly on the fixing film, and prevents water vapor generated near the fixing nip portion from condensing on the pressure roller 32 by exhausting air from the fixing film side. However, the arrangement of the blowing and exhausting mechanism unit is not limited to that shown in FIG. 1. For example, the blowing and exhausting mechanism unit may face the pressure roller in order to prevent the temperature rise of the non-paper-passage portions of the pressure roller, or may be provided opposite to the fixing film or the pressure roller and downstream of the fixing device in order to exhaust water vapor out of the image forming apparatus.

Table 1 shows the outline of the control of the blowing and exhausting mechanism unit 20B in this example. The blowing and exhausting mechanism unit in this example automatically controls the air volume of the fans 41 and the blowing area of the openings on the basis of environmental information from an environment detecting sensor (not shown) that detects the installation environment of the apparatus, paper width (size) information from a paper width sensor, and temperature rise state information of the fixing device obtained by a fixing count prediction method. By controlling power supply to the blowing and exhausting mechanism unit, the rotation direction of the fans 41 can be switched to forward rotation or reverse rotation and can thereby be switched to the blowing mode or the exhausting mode at the right time during printing. The fixing count prediction method will be described later.

TABLE 1

| Fixing count | Humidity | Blower device | Openings | Purpose |
|---|---|---|---|---|
| Less than 1001 (pressure roller temperature is estimated to be lower than 75° C.) | 80% or higher | exhausting mode | Fully open (region b) | Prevention of condensation slip |
| | Lower than 80% | Blowing mode | Corresponding to paper width (region b or narrower) | Prevention of temperature rise of non-paper-passage portions |
| 1001 or more (pressure roller temperature is estimated to be 75° C. or higher) | Any humidity | | | |

(1) Exhausting Mode

In the case where the control circuit unit 100 determines that it is a high-humidity environment and the fixing device is cold on the basis of information from the environment sensor and information on temperature rise of the fixing device obtained by a fixing count prediction method, the control circuit unit 100 moves the shutters 44 to the fully opened position, thereby fully opening the openings 43. Then, the control circuit unit 100 controls power supply to the blowing and exhausting mechanism unit and switches the rotation of the fans to the exhausting direction. In this example, in the case where the humidity is 80% or higher and the pressure roller temperature is estimated to be lower than 75° C., it is determined that it is a high-humidity environment and the fixing device is cold. That is to say, in the case where printing is performed on paper that has been left in a high-humidity environment and contains a large amount of moisture and the pressure roller is cold (in a cold state), the blowing and exhausting mechanism unit is switched to the exhausting mode and water vapor generated from the paper passage region is sucked and exhausted out of the apparatus in order to prevent condensation on the pressure roller. In this example, the blowing and exhausting mechanism unit is provided on the fixing film side. Therefore, water vapor generated near the nip is prevented from easily flowing toward the pressure roller, and condensation on the pressure roller is prevented. As described above, the exhausting mode is a mode in which the fans of the blower unit are rotated reversely and the air in the fixing unit is exhausted out of the image forming apparatus.

(2) Blowing Mode

On the other hand, in the case where the control circuit unit 100 determines that it is not a high-humidity environment and the fixing device is not cold on the basis of information from the environment sensor and information on temperature rise of the fixing device, even during the printing operation, the control circuit unit 100 changes the blowing area (opening width) on the basis of paper size information, controls power supply to the blowing and exhausting mechanism unit, and switches the rotation of the fans to the blowing direction. In this example, in the case where the humidity is lower than 80% and the pressure roller temperature is estimated to be 75° C. or higher, it is determined that the fixing device is not cold. That is to say, under an environment in which water vapor is less likely to be generated or in the second half of a continuous print job, the fans are switched to the blowing mode and the non-paper-passage portions of the fixing unit are cooled in order to prevent the temperature rise of the fixing members in the non-paper-passage portions. In this example, locating the blowing and exhausting mechanism unit on the fixing film side prevents the temperature rise of the non-paper-passage portions of the fixing film that is low in heat capacity and the temperature of which is easy to raise. As described above, the blowing mode is a mode in which the blower unit blows on the non-paper-passage portions of the fixing unit.

As described above, the blower unit can be switched during the image forming operation between a blowing mode in which the blower unit blows on the non-paper-passage portions and an exhausting mode in which the fans of the blower unit are rotated reversely and the air in the fixing unit is exhausted out of the apparatus.

Next, the fixing count prediction method by which the temperature rise state in the fixing unit is predicted will be described. In the fixing count prediction method in this example, a factor is added with every predetermined time during the printing operation, and the temperature of the pressure roller is predicted on the basis of the accumulated count. Specifically, the printing operation is divided into several stages, for example, preliminary heating time (the time from when energization of the heater is started till when the paper ejection sensor is turned on), paper passage time (the time from when the paper ejection sensor is turned on till when the paper ejection sensor is turned off), intersheet time (the time from when the paper ejection sensor is turned off till when the paper ejection sensor is turned on), and main body shutdown time (the time when the printing operation is completed), and a different factor is determined for each time division (referred to as operation state or operation stage). This factor is a value proportional to the quantity of heat applied to the pressure roller per unit time and is calculated from the difference in input power, the difference in heat release, or the like in each operation time. The factor has, for example, the values given in Table 2. In each operation state (also referred to as operation stage), with every 200 msec, each factor is added. On the basis of the accumulated count, the temperature of the pressure roller is predicted. When the main body is powered off, the accumulated count is reset. However, when the main body is powered on, the initial value of accumulated count is determined on the basis of information of the temperature sensor TH1. After that, with every predetermined time, the factor is added to the initial value. In the case where environmental information from the environment detecting sensor can be obtained, the factor to be added may be corrected on the basis of the temperature and humidity. In that case, the temperature of paper, the heat release of the pressure roller, the input power, and the like that differ depending on environment are taken into account as factors influencing the temperature of the pressure roller in order to improve the accuracy of prediction of the actual temperature of the pressure roller. The temperature predicted by this fixing count method is the pressure roller temperature in the minimum paper passage width W3 region that is not influenced by the temperature rise of the non-paper-passage portions. The method for predicting the temperature rise state of the fixing device is not limited to the above-described method. The temperature rise state of the fixing device may be determined from the number of printed sheets. The pressure roller temperature may be directly detected with a temperature detecting sensor or the like.

TABLE 2

| | Accumulated count | | |
|---|---|---|---|
| Operation state | 0 to 1000 | 1001 to 3000 | 3001 or more |
| Preliminary heating time | +7 | +5 | +3 |
| Paper passage time | +5 | +3 | +1 |
| Intersheet time | +3 | +2 | +1 |
| Main body shutdown time | −5 | −10 | −20 |

Figure 7:
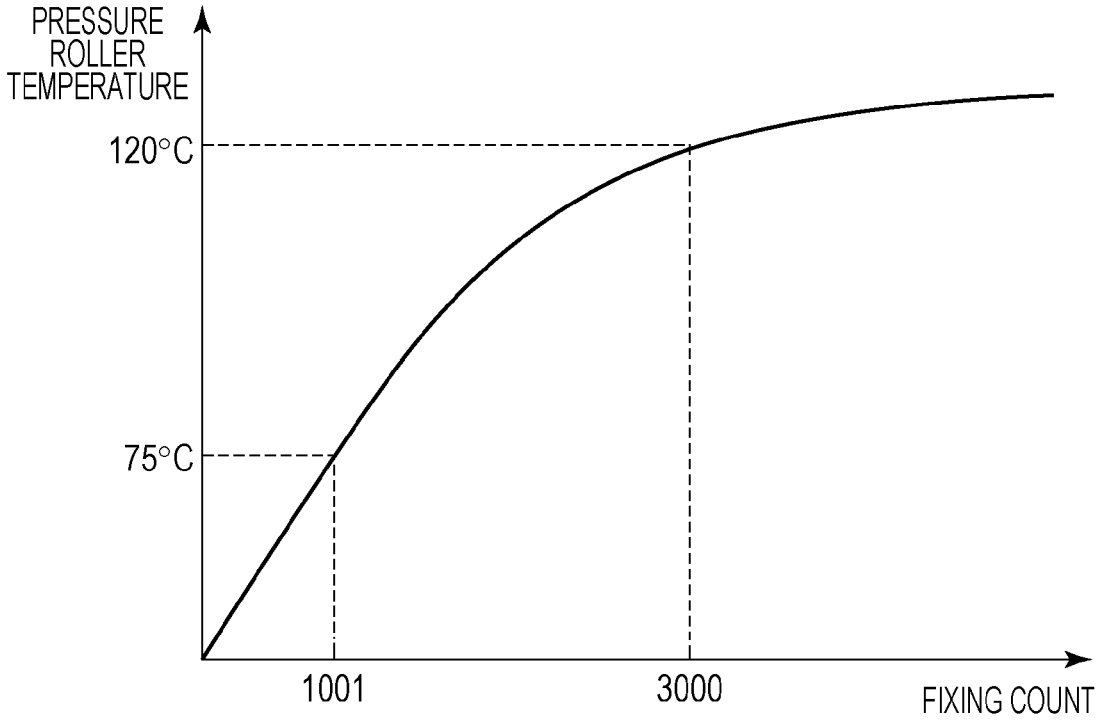
FIG. 7 shows the relationship between the fixing count and the pressure roller temperature.

FIG. 7 shows the relationship between the accumulated count and the pressure roller temperature in the fixing count prediction method. In this embodiment, in the case where the pressure roller temperature is lower than 75° C., it is determined that the fixing device is cold. That is to say, in the early stage of printing under a high-humidity environment, if information that the accumulated count is less than 1001 is input into the control circuit unit 100, the rotation of the fans is in the exhausting direction. On the other hand, if the accumulated count becomes 1001 or more in the second half of a continuous print job or due to frequently repeated intermittent printing, it is determined that the fixing device is not cold (hot), and the rotation of the fans is switched to the blowing direction.

Next, the details of the blowing and exhausting mechanism unit will be described. As described above, the blowing and exhausting mechanism of this example fully opens the blowing area (opening width) in the case where the exhausting mode is selected, and the mechanism changes the blowing area on the basis of paper size information in the case where the blowing mode is selected. The method for changing the blowing area on the basis of paper size information will be described below.

Figure 5:
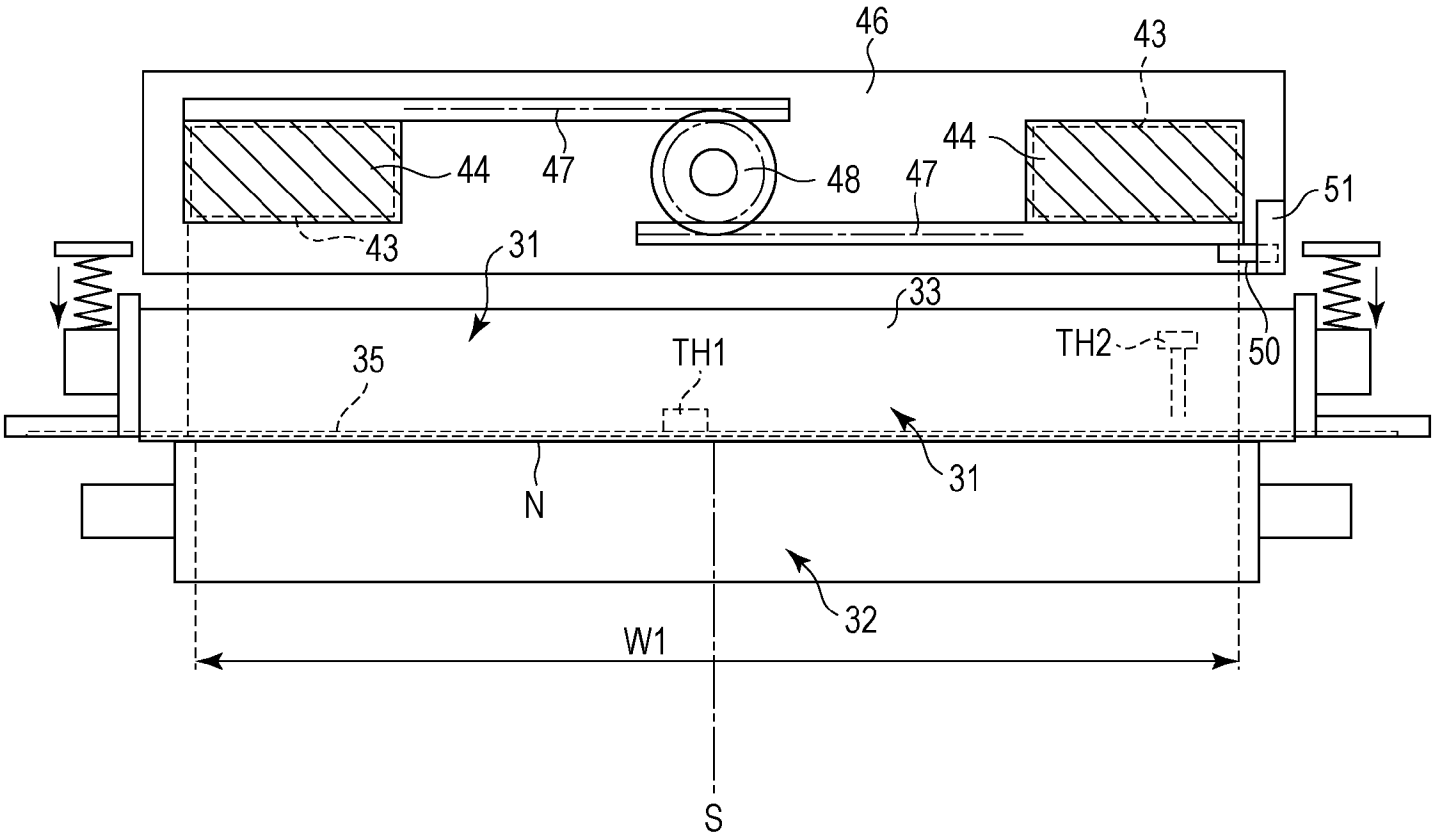
FIG. 5 shows a state where shutters are at fully closed positions where the shutters fully close openings.
Figure 6:
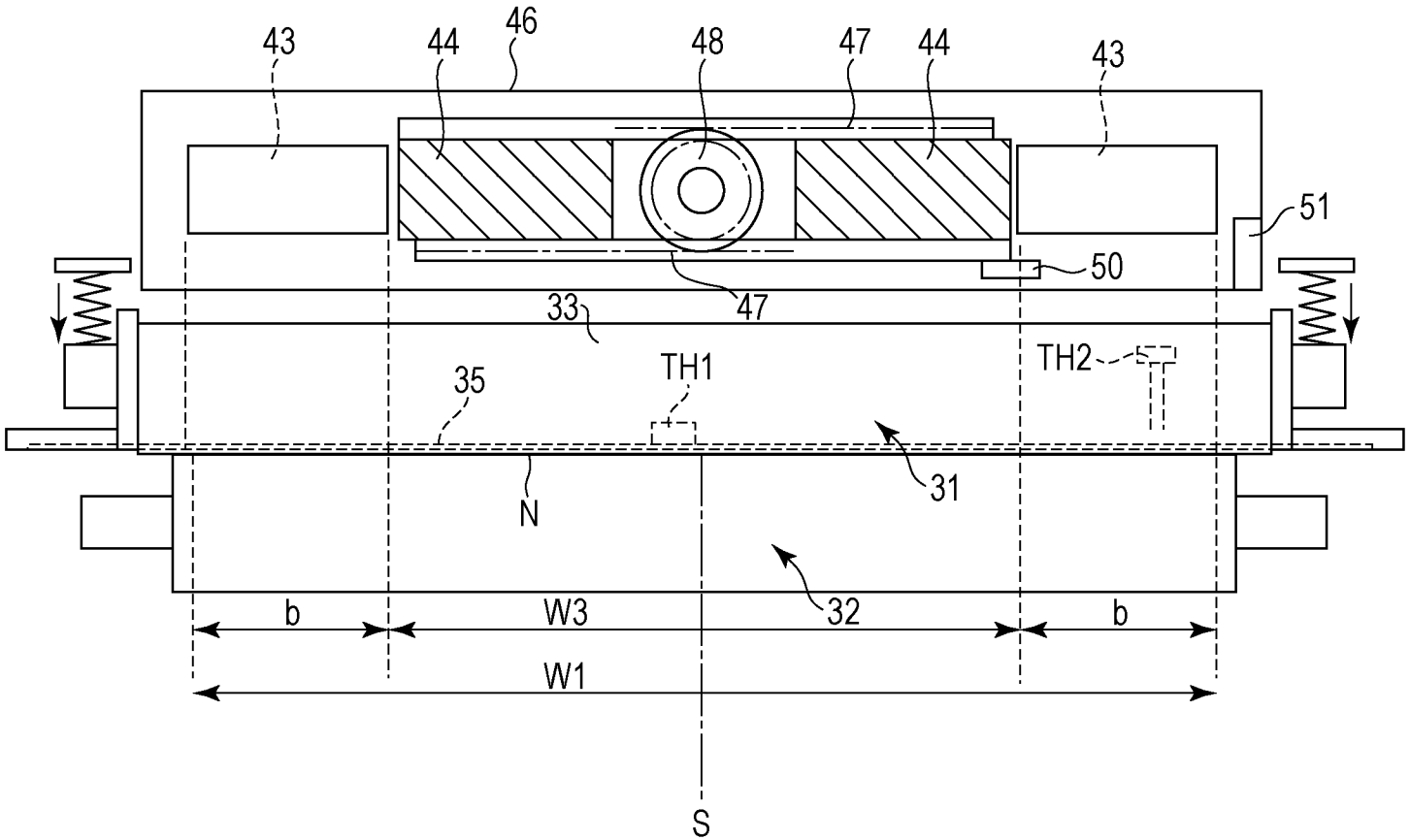
FIG. 6 shows a state where the shutters are at fully open positions where the shutters fully open the openings.

On the basis of information such as the size of the recording material to be used input by the user or the recording material width detected by a mechanism (not shown) that automatically detects the width of the recording material in a paper cassette 13 or manual paper feed tray 17, the width W (shown in FIG. 3) of the recording material to be passed is input into the control circuit unit 100. On the basis of the information, the control circuit unit 100 controls the shutter drive device 45. That is to say, by driving the motor M2, rotating the pinion gear 48, and moving the shutters 44 with the racks 47, the openings 43 can be opened by a predetermined amount. When the recording material width information is a large-size recording material of A3 size width, the control circuit unit 100 controls the shutter drive device 45 and moves the shutters 44 to fully closed positions where the shutters 44 fully close the openings 43 as shown in FIG. 5. At this time, the rotation of the fans may be stopped. In the case of a small-size recording material of A4R size width, the shutters 44 are moved to fully open positions where the shutters 44 fully open the openings 43 as shown in FIG. 6. In the case of a small-size recording material of B4 size width, the shutters 44 are moved to positions where the shutters 44 partially open the openings 43 such that the openings 43 correspond to the non-paper-passage portions a. In the case where the small-size recording material to be passed is LTR-R, EXE, K8, LTR, or the like, the control circuit unit 100 moves the shutters 44 to positions where the shutters 44 partially open the openings 43 such that the openings 43 correspond to the non-paper-passage portions formed in that case. That is to say, the shutters 44 can adjust the width (blowing width) of the openings 43 according to the width of the recording material. The "minimum sheet size," "maximum sheet size," and "all sheet sizes" in this example mean those of standard size paper guaranteed to be usable in the main body of the image forming apparatus and does not mean those of paper including non-standard-sized paper specially used by the user. The positional information of the shutters 44 is obtained by detecting a flag 50 disposed at a predetermined position on one of the shutters 44 with a sensor 51 disposed on the supporting plate 46. Specifically, as shown in FIG. 5, a home position is determined at a shutter position where the openings 43 are fully closed, and the amount of opening is detected from the amount of rotation of the motor M2. Alternatively, the apparatus may be equipped with an opening width detecting sensor that directly detects the present positions of the shutters 44, and shutter position information detected by the sensor may be fed back to the control circuit so that the shutters 44 can be moved to proper opening width positions corresponding to the width of the recording material to be passed. By detecting the edge positions of the shutters with a sensor, the stopping positions of the shutters corresponding to the length in the width direction of the small-size recording material can be determined with a high degree of accuracy. Therefore, blowing for cooling can be performed only to the non-paper-passage regions of all small-size recording materials.

Next, the control of the rotation speed of the fans in this example will be described. The fans used in this example can generate an airflow of 0.44 $m^3$/min when the motor rotation speed at rated voltage is 100%. The rotation speed and rotation direction of the motor can be changed as needed according to the environment, the temperature rise state of the fixing device, and the like. By changing the rotation speed and rotation direction of the motor, the amount of air sent to the fixing unit and the amount of suction of water vapor generated from the recording material are regulated, and the balancing of condensation slip and fixing property in the cold state and the prevention of temperature rise of the non-paper-passage portions in the second half of continuous printing are performed.

Figure 8A:
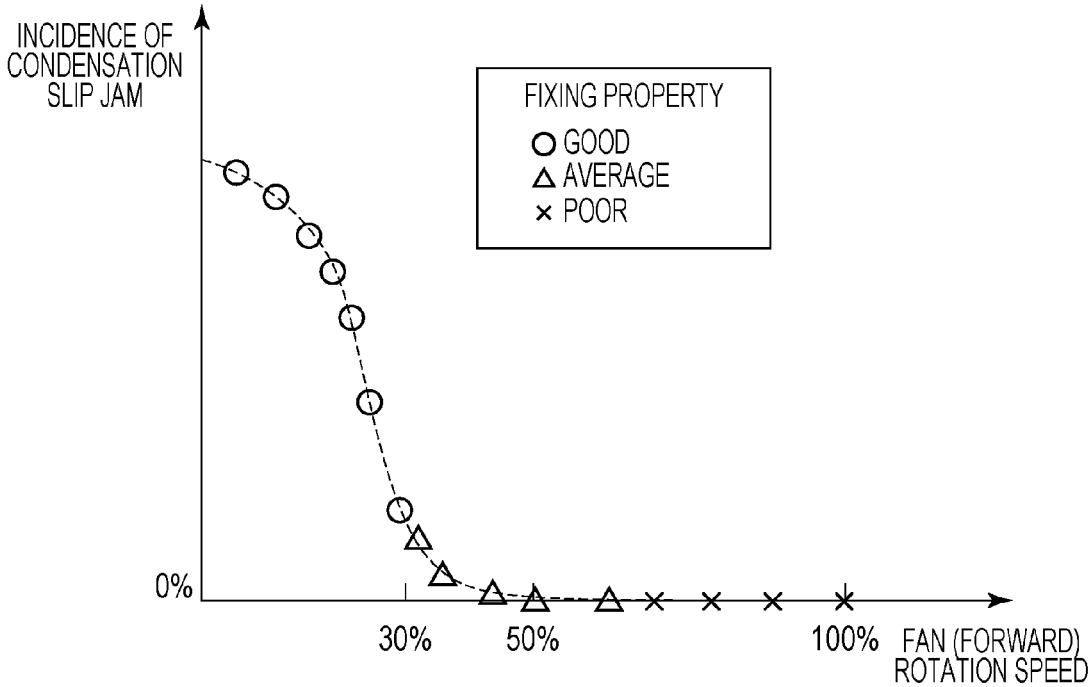
FIGS. 8A and 8B show the relationship of the condensation slip and the fixing property to the fan rotation speed.

FIG. 8A shows the relationship of the condensation slip and the fixing property to the rotation speed of the fans in a comparative example (a device that can perform only the blowing mode). Under such conditions that the environment is high temperature and high humidity (32.5° C., 85%), that the paper is of LTR size and has sufficiently absorbed moisture, and that the image is printed on the whole surface of the paper (solid image), continuous printing of about 20 sheets was performed from cold start until the estimated pressure roller temperature reached 75° C. (until the fixing count reached 1001). That is to say, continuous printing of small-size paper was performed at a time when condensation is likely to occur.

From FIG. 8A, the incidence of jam caused by condensation slip decreases with the increasing rotation speed of the fans, and the incidence of jam is zero when the rotation speed is 50% or more. The amount of air sent to the fixing unit through the openings increases with the increasing rotation speed of the fans, and water vapor generated from the recording material is probably diffused out of the fixing device. That is to say, condensation on the pressure roller is probably prevented. However, because air is sent to the fixing unit, the temperature of the fixing unit near the non-paper-passage regions decreases due to the influence of the air sent in, and therefore the fixing property of the end portions worsens. In order to satisfy a good fixing property, the motor rotation speed needs to be limited to no more than 30%. That is to say, if one tries to deal with a severe paper passage mode such as that under the above-described conditions with only the blowing mode, it is difficult to balance fixing property and condensation slip only by adjusting the motor rotation speed.

Figure 8B:
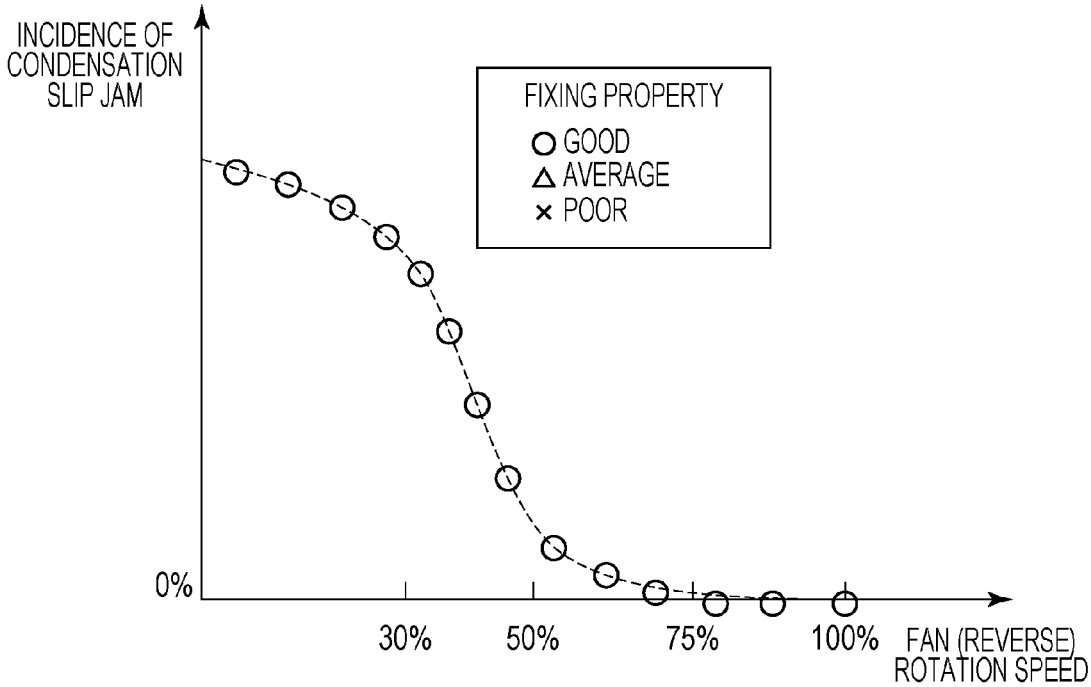

On the other hand, FIG. 8B shows the result of this embodiment. The paper passage conditions are the same as in the case of the comparative example. In this experiment, the humidity is 80% or higher and the fixing count is less than 1001, and therefore the fans of this embodiment rotate reversely and perform the exhausting operation. From FIG. 8A, with the increasing reverse rotation speed of the motor, water vapor exhausting capacity increases, and the incidence of jam caused by condensation slip decreases. However, compared to the forward rotation speed 50% of the comparative example, the reverse rotation speed needs to be increased to 75% in order to completely prevent the jam caused by condensation slip. That is to say, in terms of the effect of diffusing water vapor out of the fixing device, the exhausting of air is slightly disadvantageous when the motor rotation speed is the same. However, because nothing other than sucking water vapor is done, the temperature decrease of the fixing unit is negligible, and the fixing property does not worsen. Therefore, in a severe paper passage mode such as that under the above-described conditions, fixing property and condensation slip can be balanced by reversing the rotation direction of the motor and increasing the rotation speed of the motor to 75% or more. However, the rotation speed of the motor and the optimum air volume depend on the input power, the material of the fixing member, the width and position of the openings of the fans, and are not limited to those described above.

Figure 9:
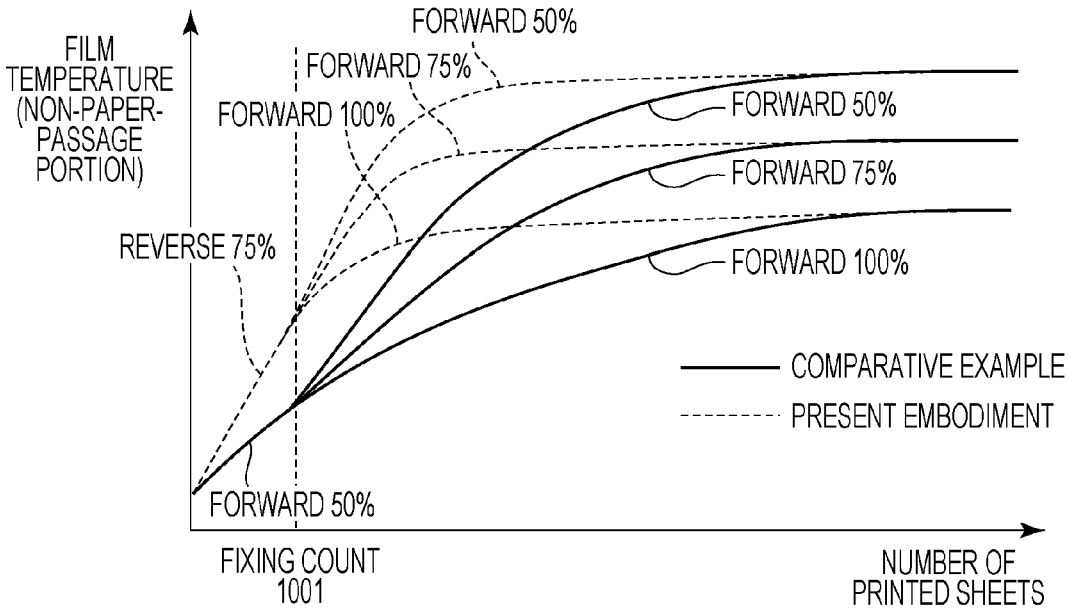
FIG. 9 shows the relationship of the temperature rise of the non-paper-passage portions to the fan rotation speed.

FIG. 9 shows an example of comparison between the comparative example and the present embodiment in terms of the temperature rise of the non-paper-passage portions in the second half of continuous printing. The horizontal axis shows the number of passed sheets, and the vertical axis shows the temperature of the hottest part of the fixing film. Under the same paper passage conditions as those described above, continuous printing of 200 sheets was performed from a cold start until the temperature of the fixing member was sufficiently saturated. The motor in the present embodiment was operated in the exhausting mode capable of preventing condensation slip (reverse rotation 75%) until the fixing count reached 1001 in the early stage of paper passage, and in the blowing mode (forward rotation 50%, 75%, and 100%) in order to prevent the temperature rise of the non-paper-pas sage portions when the fixing count was 1001 or more. On the other hand, the motor in the comparative example was operated in forward rotation 50% capable of preventing condensation slip until the fixing count reached 1001 in the early stage of paper passage, and in forward rotation 50%, 75%, and 100% in order to prevent the temperature rise of the non-paper-passage portions when the fixing count was 1001 or more.

controlled on the basis of the temperature rise information of the temperature sensor of the non-paper-passage portion. In order to optimize the balance between the cooling effect against the temperature rise of the non-paper-passage portions and the fixing property of the end portions, the rotation speed of the fans may be controlled continuously on the basis of temperature humidity information, or the threshold value of the fixing count may be changed.

TABLE 3

| | | Fan rotation direction/ rotation speed | | Various phenomena | | | |
|---|---|---|---|---|---|---|---|
| | | Cold | Hot | Cold | | Hot | |
| | Humidity | Fixing count is less than 1001 | Fixing count is 1001 or more | Condensation slip jam | Fixing property of end portions | Temperature rise of non-paper-passage portions | Fixing property of end portions |
| Present embodiment | 80% or higher | Reverse rotation/75% or more | Forward rotation/ 50% to 75% | Good | Good | Good | Good |
| Comparative example | | Forward rotation/30% or less | | Poor | Good | Good | Good |
| | | Forward rotation/30% to 74% | | Average | Average | Good | Good |
| | | Forward rotation/75% or more | | Good | Poor | Good | Good |
| Present embodiment | Lower than 80% | Forward rotation/30% or less | | Good | Good | Good | Good |
| Comparative example | | | | Good | Good | Good | Good |

From FIG. 9, when comparing the temperature rise of the non-paper-passage portions in the present embodiment to that in the comparative example, although there is a difference in the rate of temperature rise in the early stage of paper passage, there is little difference in the saturation temperature of the fixing film in the second half of continuous printing. In the case of the present embodiment, in the early stage of paper passage, due to the exhaustion of air by the reverse rotation, there is little cooling effect on the fixing film. Therefore, compared to the blowing by forward rotation of the comparative example, the temperature of the fixing film rises rapidly. However, when the fixing count becomes 1001 or more, the motor is switched to forward rotation, and the cooling effect on the fixing unit increases rapidly. For this reason, the saturation temperature is reached in a short time, but finally the temperature at which the fixing film is saturated is the same as in the case of the comparative example. Such a tendency does not change even when paper passage conditions such as environment, paper size, and image pattern are changed.

Table 3 shows the motor rotation speeds and the results of effect confirmation in the present embodiment and the comparative example. In the present embodiment, under a high-humidity environment of 80% or higher where water vapor is likely to be generated and in a cold state where the fixing unit is cold, the fans are switched to reverse rotation (exhaustion) and the water vapor generated from the paper passage region is sucked in order to prevent condensation on the pressure roller. On the other hand, under a low-humidity environment lower than 80% where water vapor is less likely to be generated or in the second half of a continuous print job (in a hot state), the fans are switched to forward rotation (blowing) and the fixing unit is cooled in order to prevent the temperature rise of the fixing unit in the non-paper-passage portions. The rotation speed of the fans in the blowing direction may be As described above, by switching the rotation direction of the fans between blowing and exhaustion according to the environment and the temperature rise state of the fixing unit, the temperature rise of the non-paper-passage portions during continuous paper passage can be restrained, and the condensation slip in the early stage of printing under a high-humidity environment can be restrained without causing a fixing defect. By using a plurality of fans (fans exclusively for blowing and fans exclusively for exhaustion), the same advantageous effects as in the present embodiment can be obtained. The temperature rise determination unit, environment detection unit, and paper-size determination unit in the present embodiment are effective units for improving the effect of the blowing and exhaustion of the fans. However, if the rotation direction of the fans is switched without using these units, for example, on the basis only of information on whether or not it is the second half of continuous printing when the temperature rise of the non-paper-passage portions is severe, advantageous effects close to those in the present embodiment can be obtained.

Second Embodiment

Figure 10:
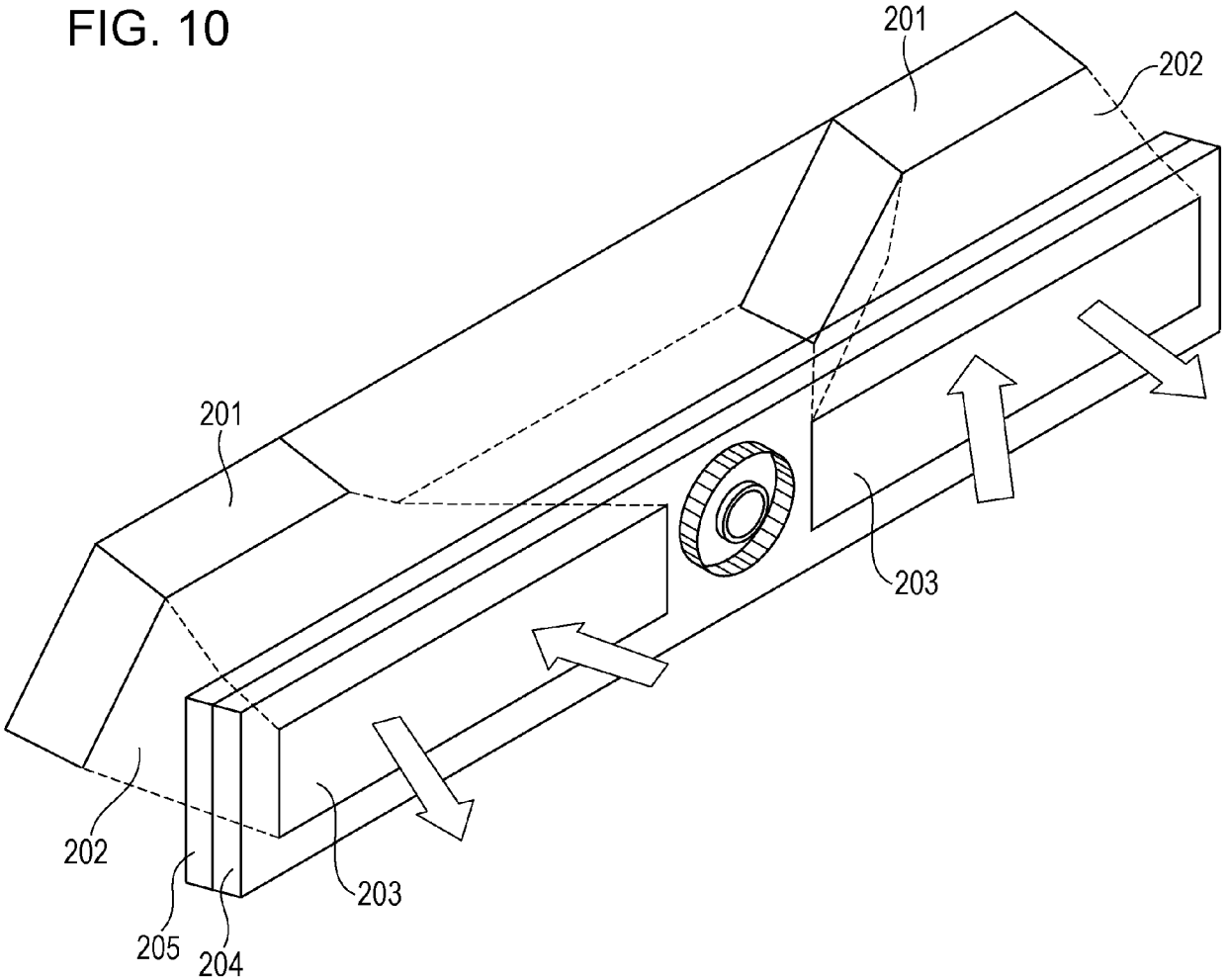
FIG. 10 is a perspective view of a blower unit of a second embodiment.

In the present embodiment, in order to raise the exhaustion efficiency in the case where the fans rotate reversely, a change is made to the blowing and exhausting mechanism unit in the first embodiment as shown in FIG. 10. Except for the above-described respect, the present embodiment is the same as the first embodiment, and so the description thereof will be omitted.

Figure 11:
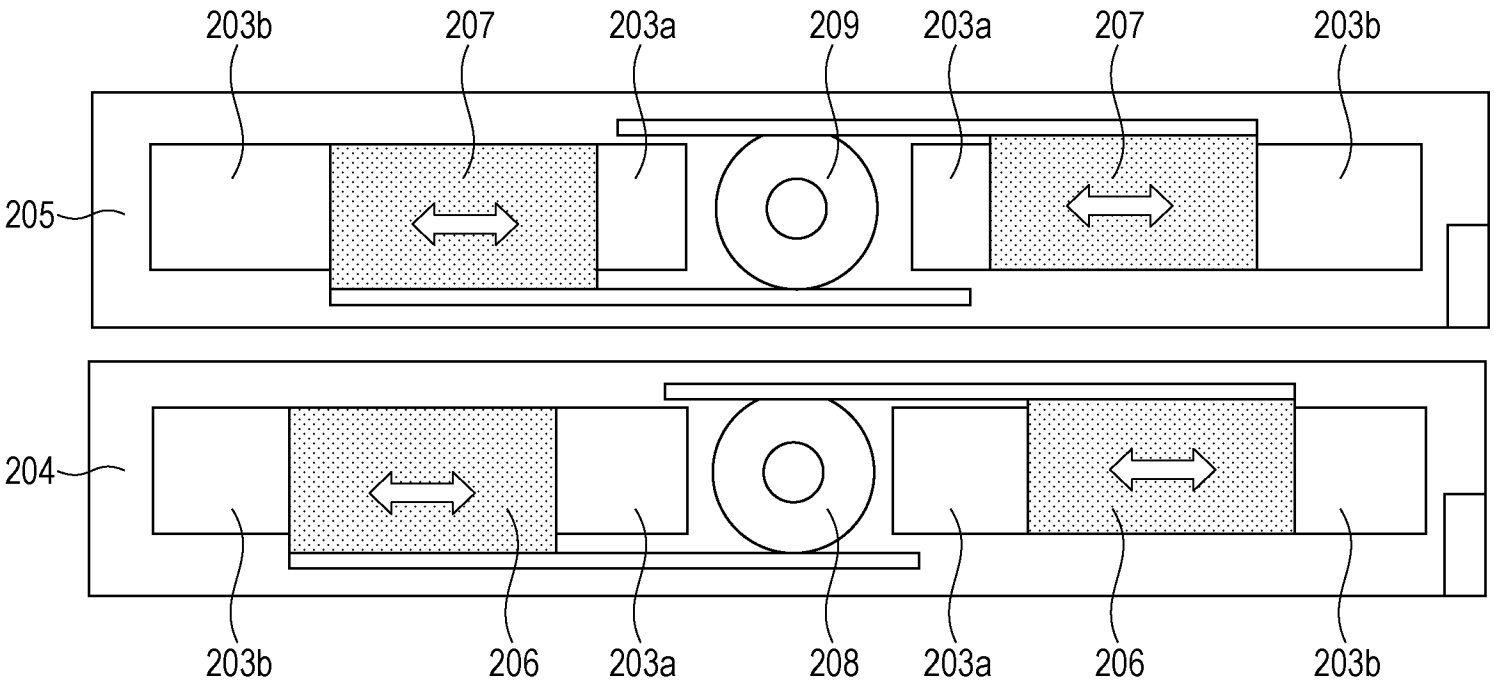
FIG. 11 is a front view of openings of the blower unit of the second embodiment.

FIG. 10 is a schematic view of a blowing and exhausting mechanism unit in the present embodiment. The blowing and exhausting mechanism unit has fans 201 that can be switched between the blowing mode and the exhausting mode. The blowing and exhausting mechanism unit has ducts 202 that conduct air blown and exhausted by the fans 201, and openings 203 disposed in parts of the ducts 202 facing the fixing unit 20A. The openings 203 are formed through two supporting plates 204 and 205 that are superimposed on each other with no gap therebetween. FIG. 11 is a front view of the openings 203. The blowing and exhausting mechanism unit has shutters 206 and 207 that open and close the openings 203 and adjust the opening width to an appropriate width according to conditions, and shutter drive devices (opening width adjusting units) 208 and 209 that drive the shutters. The shutters 206 and 207 slide left-right symmetrically and can adjust the slide width independently. Because the openings are wider than the shutters, inner opening 203*a* and outer opening 203*b* are formed depending on the positions of the shutters. The shutter drive mechanisms are the same as that of the first embodiment, and so the description thereof will be omitted.

Figure 12:
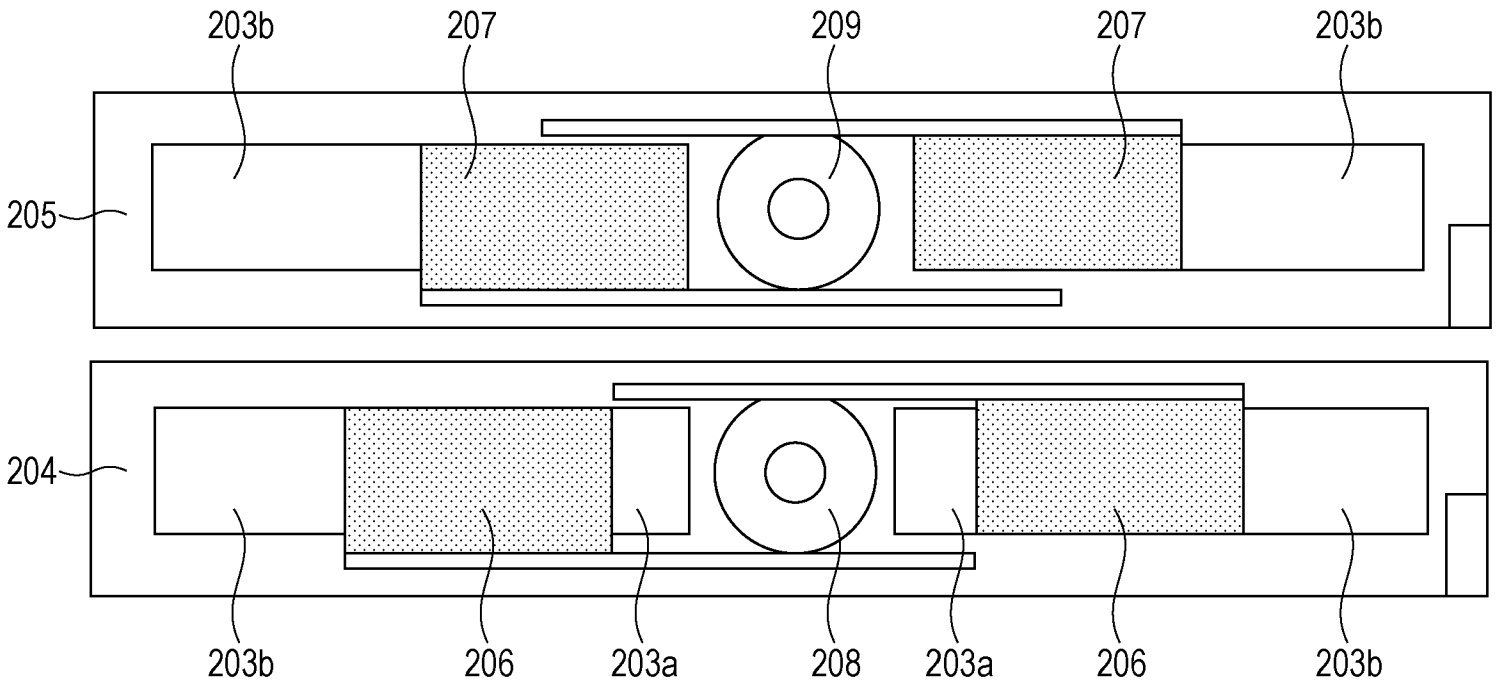
FIG. 12 illustrates the operation of shutters in the case where the blowing mode is selected in the second embodiment.

FIG. 12 illustrates the operation of the shutters 206 and 207 in the case where the blowing mode is selected in the present embodiment. In the case where the blowing mode is selected in order to prevent the temperature rise of the non-paper-passage portions, control is performed on the basis of paper-size information such that air is sent to the same region as in the first embodiment. Therefore, the shutters 207 close the longitudinally inner openings 203*a* corresponding to the paper passage portion, and the shutters 206 move to such positions that the width of the openings 203*b* corresponds to the width of the non-paper-passage portions a. Because the supporting plates 204 and 205 are superimposed on each other with no gap therebetween, air passing through the openings 203*b* of the supporting plate 205 is not sent through the longitudinally inner openings 203*a* of the supporting plates 204.

Figure 13:
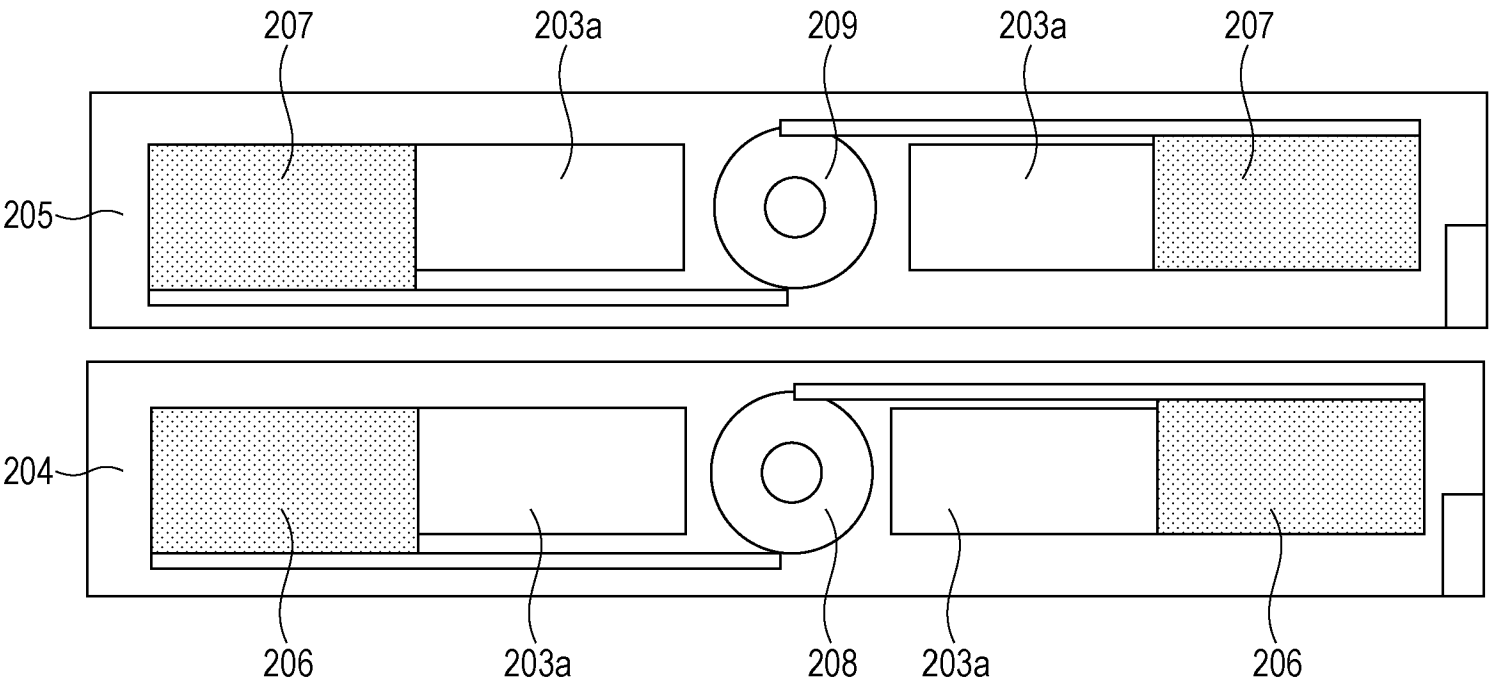
FIG. 13 illustrates the operation of shutters in the case where the exhausting mode is selected in the second embodiment.
Figure 14:
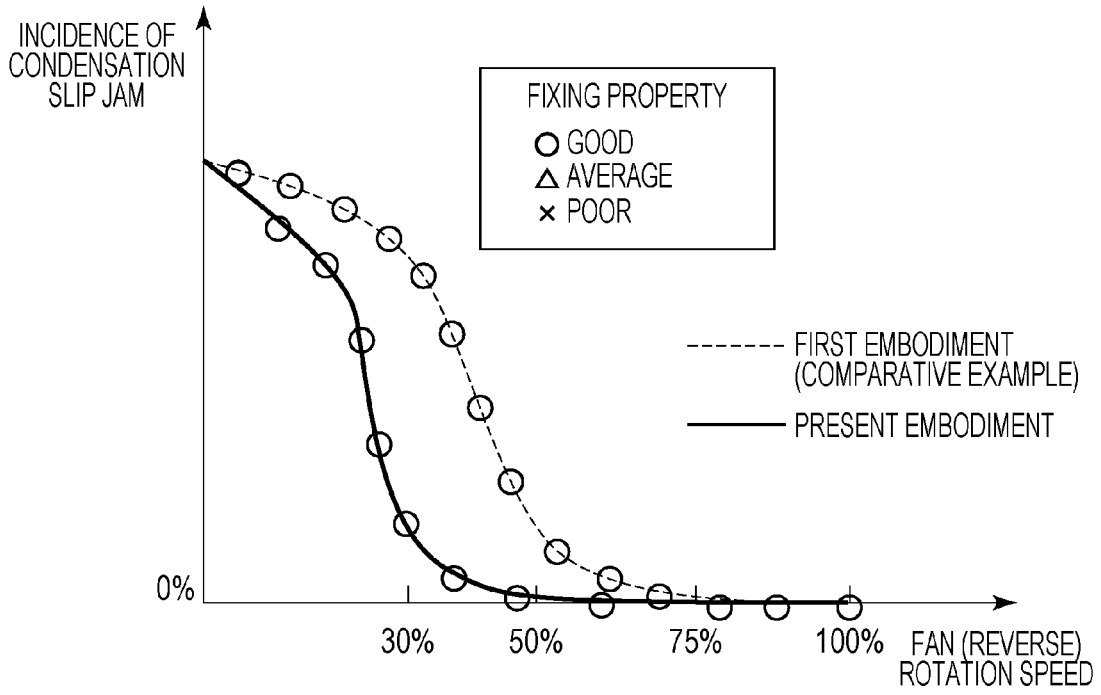
FIG. 14 shows the relationship of the condensation slip and the fixing property to the fan rotation speed in the second embodiment.

On the other hand, FIG. 13 illustrates the operation of the shutters 206 and 207 in the case where the exhausting mode is selected in the present embodiment. In the case where the exhausting mode is selected in order to prevent condensation slip, the shutters 206 and 207 are moved to the outer ends in the longitudinal direction, and the longitudinally inner openings 203*a* corresponding to the paper passage portion are opened. Compared to the first embodiment in which air is exhausted from the non-paper-passage portions, water vapor generated from the recording material can be exhausted efficiently. Therefore, as shown in FIG. 14, the jam caused by condensation slip can be prevented at a lower motor rotation speed. As a result, the power consumption of the motor driving the fans can be reduced, and the life-span of the motor and the fans can be extended.

Third Embodiment

The present embodiment is characterized in that in the blowing and exhausting mechanism units of the first and second embodiments, the operation state of the fans during printing operation is switched between three modes of forward rotation, reverse rotation, and stop on the basis of temperature humidity information, temperature rise information of the fixing unit, and paper passage mode in order to reduce the power consumption of the motor and to extend the life-span of the motor and fans. The apparatus configuration is the same as those of the first and second embodiments, and so the description thereof will be omitted.

In the blowing and exhausting mechanism unit of the present embodiment, as in the first and second embodiments, under a high-humidity environment of 80% or higher where water vapor is likely to be generated and in a cold state where the fixing unit is cold, the fans are switched to reverse rotation (exhaustion) and the water vapor generated from the paper-passage region is sucked in order to prevent condensation on the pressure roller. On the other hand, under a low-humidity environment lower than 80% where water vapor is less likely to be generated or in the second half of a continuous print job (in a hot state), the fans are switched to forward rotation (blowing) and the fixing unit is cooled in order to prevent the temperature rise of the fixing member in the non-paper-passage portions. However, in the present embodiment, even when the humidity is 80% or higher and it is determined that the fixing unit is cold, the fans are stopped in the case where a mode in which condensation slip is less likely to occur is selected, for example, printing on the second surface in automatic duplex printing in which the amount of water vapor generation is small, printing of a low printing rate in which water vapor is likely to diffuse in all directions in the fixing nip portion, or small-size printing in which the area where water vapor is generated is small. Alternatively, the rotation speed of the fans is reduced compared to the other print modes. On the other hand, also in the case where the fans are rotated forward in order to prevent the temperature rise of the non-paper-passage portions, instead of always rotating the fans forward when it is determined that the fixing unit is not cold as in the first embodiment, the fans are stopped or slowed down until a predetermined threshold value within a range not to exceed the limit temperature of the fixing unit is exceeded on the basis of the fixing count and the temperature rise information of the temperature sensor TH2 in the non-paper-passage portion. In the case, for example, of continuous printing of large-size paper or an intermittent print mode, the temperature of the non-paper-passage portions is less likely to rise, and so the fans are stopped or slowed down. As described above, by slowing down or stopping the rotation of the fans during printing operation on the basis of temperature humidity information, temperature rise information of the fixing unit, and paper passing mode, the power consumption of the motor driving the fans can be reduced, and the life-span of the motor and the fans can be extended.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-273895 filed Dec. 8, 2010, which is hereby incorporated by reference herein in its entirety.

What is claimed is:

1. An image forming apparatus comprising:

a fixing unit that fixes an unfixed image to a recording material while nipping and conveying the recording material bearing the unfixed image; and a blower unit that sends air to a non-paper-passage portion of the fixing unit and cools the non-paper-passage portion;

wherein the blower unit can be switched between a blowing mode in which the blower unit sends air to the non-paper-passage portion and an exhausting mode in which a fan of the blower unit is rotated reversely and the air in the fixing unit is exhausted out of the image forming apparatus, and wherein the image forming apparatus performs the exhausting mode in an early stage of continuous printing and then switches to the blowing mode.

2. The image forming apparatus according to claim 1, wherein the image forming apparatus sets the blowing mode or the exhausting mode on the basis of information on at least one of a temperature rise state of the fixing unit, an environment of the image forming apparatus, and a size of the recording material.

3. The image forming apparatus according to claim 1, wherein the image forming apparatus can be switched between the blowing mode and the exhausting mode during an image forming operation.

4. The image forming apparatus according to claim 1, wherein the blower unit has an opening through which air passes and a width of which can be changed, and a position of the opening changes according to switching between the blowing mode and the exhausting mode.

5. The image forming apparatus according to claim 1, wherein the blower unit sends air to a region corresponding to the non-paper-passage portion when set to the blowing mode, and exhausts air from a region corresponding to a paper-passage portion when set to the exhausting mode.

6. The image forming apparatus according to claim 1, wherein the fixing unit has an endless belt, a heater in contact with an inner surface of the endless belt, and a pressure roller that forms a fixing nip portion together with the heater with the endless belt therebetween, and the fixing unit fixes the unfixed image to the recording material while nipping and conveying the recording material bearing the unfixed image with the fixing nip portion.

7. The image forming apparatus according to claim 6, wherein the blower unit is disposed so as to send air directly to the endless belt.

8. An image forming apparatus comprising:

a fixing unit that fixes an unfixed image to a recording material while nipping and conveying the recording material bearing the unfixed image; and a blower unit that sends air to a non-paper-passage portion of the fixing unit and cools the non-paper-passage portion;

wherein the blower unit can be switched between a blowing mode in which the blower unit sends air to the non-paper-passage portion and an exhausting mode in which a fan of the blower unit is rotated reversely and the air in the fixing unit is exhausted out of the image forming apparatus, and wherein the blower unit has an opening through which air passes and a width of which can be changed, and a position of the opening changes according to switching between the blowing mode and the exhausting mode.

9. The image forming apparatus according to claim 8, wherein the opening width of the opening in the blowing mode is set in accordance with a size of the recording material, and the opening width of the opening in the exhausting mode is set so that the opening fully opens.

10. The image forming apparatus according to claim 8, wherein the blower unit has a shutter for setting the position of the opening, and wherein a position of the shutter in the exhausting mode is set at an outer end of the opening.

11. The image forming apparatus according to claim 8, wherein the image forming apparatus can be switched between the blowing mode and the exhausting mode during an image forming operation.

12. The image forming apparatus according to claim 8, wherein the blower unit sends air to a region corresponding to the non-paper-passage portion when set to the blowing mode, and exhausts air from a region corresponding to a paper-passage portion when set to the exhausting mode.

13. The image forming apparatus according to claim 8, wherein the fixing unit has an endless belt, a heater in contact with an inner surface of the endless belt, and a pressure roller that forms a fixing nip portion together with the heater with the endless belt therebetween, and the fixing unit fixes the unfixed image to the recording material while nipping and conveying the recording material bearing the unfixed image with the fixing nip portion.

14. The image forming apparatus according to claim 13, wherein the blower unit is disposed so as to send air directly to the endless belt.

* * * * *